US005996551A

United States Patent [19]

Schröder

[11] Patent Number: 5,996,551

[45] Date of Patent: Dec. 7, 1999

[54] SPRING ASSEMBLY IN AN ENGINE AIR THROTTLE CONTROL PROVIDING ROTATIONAL BLOCKING WHEN RELAXED

[75] Inventor: Thomas Schröder, Berlin, Germany

[73] Assignee: Pierburg AG, Neuss, Germany

[21] Appl. No.: 09/133,027

[22] Filed: Aug. 12, 1998

[30] Foreign Application Priority Data

Aug. 13, 1997 [DE] Germany ..... 197 35 046

[51] Int. Cl.[6] ..... F02D 9/08

[52] U.S. Cl. ..... 123/337; 123/396; 123/399; 251/313; 251/336

[58] Field of Search ..... 123/337, 396, 123/399, 336, 361; 251/305, 336, 313, 337; 267/167

[56] References Cited

U.S. PATENT DOCUMENTS

| | | | |
|---|---|---|---|
| 4,867,122 | 9/1989 | Kono et al. | 123/396 |
| 4,915,075 | 4/1990 | Brown | 123/399 |
| 5,297,521 | 3/1994 | Sasaki et al. | 123/396 |
| 5,429,090 | 7/1995 | Kotachi et al. | 123/399 |
| 5,829,409 | 11/1998 | Saito et al. | 123/399 |

FOREIGN PATENT DOCUMENTS 0651147 5/1995 European Pat. Off. .

*Primary Examiner*—Henry J. Recla
*Assistant Examiner*—Khoa Huynh
*Attorney, Agent, or Firm*—Ladas & Parry

[57] ABSTRACT

A spring assembly in a throttle valve connection for control of combustion air to an internal combustion engine, in which a rotor is movable in opposite directions to control flow of combustion air. The spring assembly has a coil spring with first and second legs at respective opposite ends engaging housing and rotor parts. The housing and rotor parts are provided with respective oblique surfaces engaging one of the legs of the spring when the spring is relaxed to resist relative rotation of the housing and rotor.

8 Claims, 2 Drawing Sheets

SPRING ASSEMBLY IN AN ENGINE AIR THROTTLE CONTROL PROVIDING ROTATIONAL BLOCKING WHEN RELAXED

FIELD OF THE INVENTION

The invention relates to a spring assembly in a throttle valve connection for control of combustion air in an internal combustion engine.

More particularly, the invention relates to such a spring assembly in which the spring is formed with legs at its opposite ends which engage a part connected to the rotor and a part connected to the housing and when the throttle valve is in a neutral position, the spring is relaxed and free of stress. From this position, the rotor can be rotated in either direction which varies the position of the throttle valve.

BACKGROUND AND PRIOR ART

EP 0 651 147 B1 discloses an arrangement in which the legs at the opposite ends of the spring jointly engage the rotor part and the housing part and if electrical drive of the rotor is shut off or fails, the throttle valve will be brought to a neutral or rest position corresponding to a start position or idle emergency position.

In this neutral position, the spring is relaxed and free of stress and it has been found that objectionable fluctuations of speed of the internal combustion engine occur.

SUMMARY OF THE INVENTION

The invention is based on the discovery that the free play of the throttle valve in the neutral position when the spring is relaxed, allows the throttle valve to undergo rotation due to engine vibration which leads to fluctuation in engine speed.

An object of the invention is to provide means in the throttle valve connection which will prevent fluctuation of engine speed.

According to one aspect of the invention, this object is achieved by constructing the spring assembly in the throttle valve connection so that in the neutral position when the spring is relaxed, rotation of the rotor is resisted.

In accordance with the invention, resistance to rotation of the rotor in the neutral position when the spring is relaxed is obtained by providing oblique surfaces on a lever part connected to the rotor and a housing part connected to the housing so that in said neutral position one of the legs at the end of the spring is engaged with the oblique surfaces.

In further accordance with the invention, such oblique surfaces can be provided on the respective parts to engage the other leg at the opposite end of the spring.

According to a modification, a projection can be provided at the end of one of the parts to serve as a stop for axial travel of the leg of the spring.

DETAILED DESCRIPTION OF PREFERRED EMBODIMENTS

Figure 1:
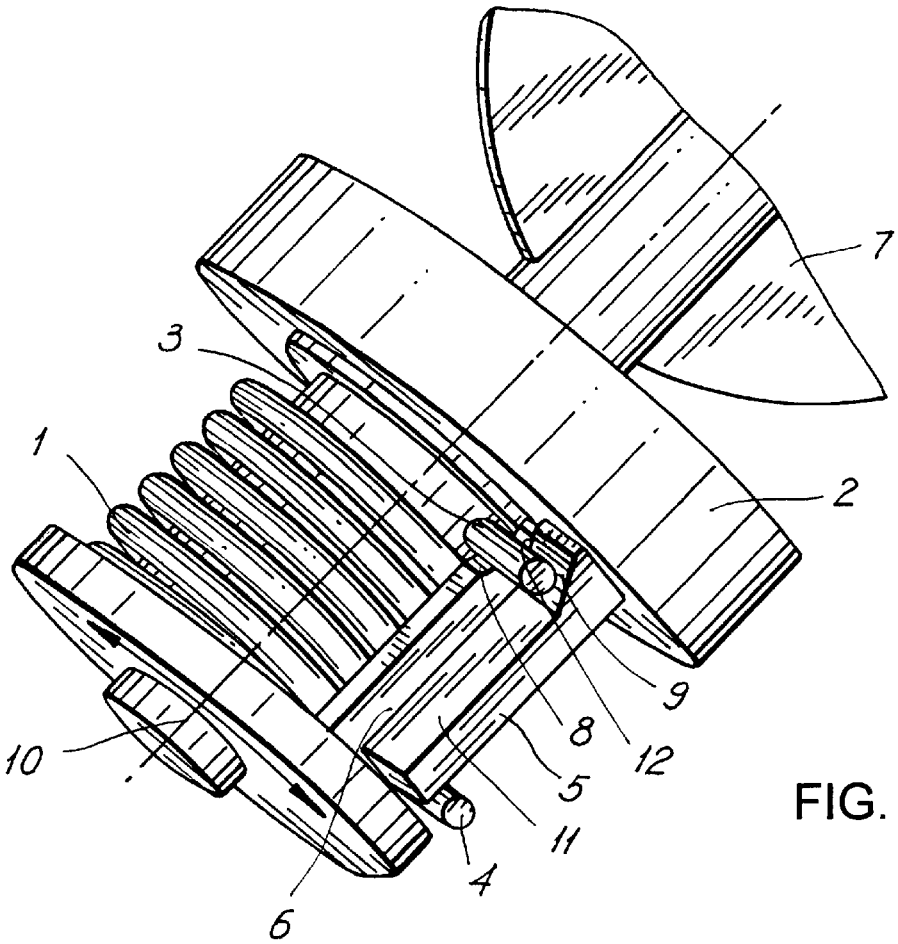
FIG. 1 is a top, perspective view of a spring assembly in a throttle valve connection according to a first embodiment of the invention.

The drawings show two embodiments of a spring assembly in a throttle valve connection which controls flow of combustion air to an internal combustion engine (not shown).

The spring assembly comprises a coil spring 1 engaged between a housing 2 and a rotor of the valve connection. The spring 1 is formed with legs 3 and 4 at its opposite ends. The housing 2 is formed with an integral finger or part 5 referred to as a housing part and the rotor is formed with an integral finger or part 6 referred to as a lever part. The housing part 5 and the lever part 6 extend substantially parallel to an axis of rotation 10 of the rotor.

FIGS. 1–4 show the rotor connection in a neutral position for the throttle valve in which the spring 1 is relaxed and free of stress. In this position, the legs 3 and 4 of the spring simultaneously engage both the housing part 5 and the lever part 6. In this position, the rotor 7 can be rotated in either direction as shown by the arrows in FIG. 1.

In th is arrangement, if the electric motor drive (not shown) is turned off or fails the throttle valve 7 will be moved by the spring to a start or emergency position.

In this neutral position of the valve, the spring is relaxed and the leg 3 of the spring is held in the rest position and rotation of the rotor is resisted by the provision of oblique surfaces 8 and 9 respectively on the housing part 5 and the lever part facing in opposite directions. Accordingly, free play between the rotor and the housing as in the prior art construction is eliminated and fluctuations in engine speed due to small movement of the rotor caused by engine vibration is prevented. The housing part 5 has a surface 11 extending parallel to the rotational axis 10 of the rotor and the lever part 6 has a corresponding surface 12 also extending parallel to the rotational axis 10. When the rotor is driven by the electric motor in either direction, the respective oblique surface on the housing part or lever part will cause the leg 3 of the spring to slide on the oblique surface 8 or 9 onto the respective parallel surface 11 or 12. The opposite leg 4 of the spring is engaged with one or the other of the parts 5 of 6 at the back side of the part depending on the direction of rotation of the rotor. The surfaces of the parts 5 and 6 at the back side extend parallel to the longitudinal axis 10 of the rotor.

Figure 2:
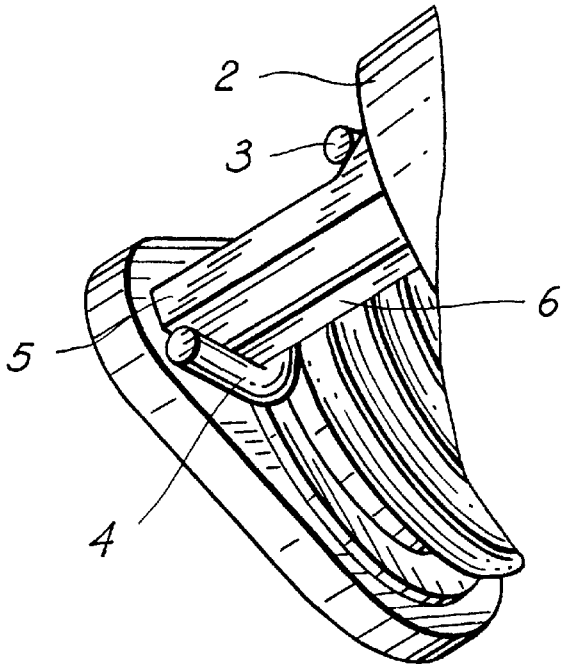
FIG. 2 is a fragmentary view of the embodiment in FIG. 1 seen from the underside.
Figure 3:
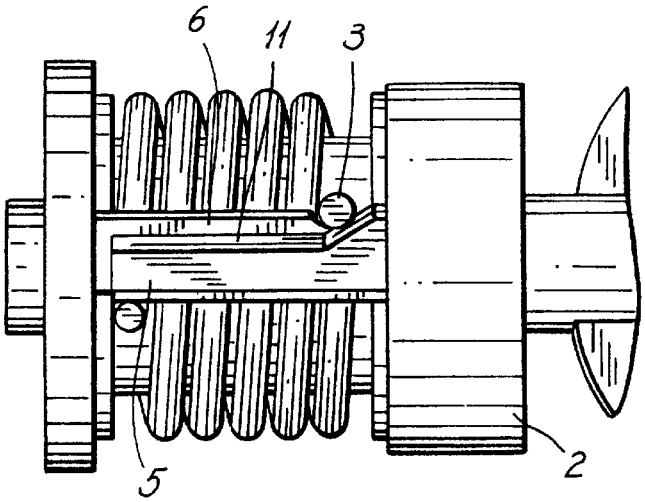
FIG. 3 is a side elevational view of the embodiment in FIG. 1.
Figure 4:
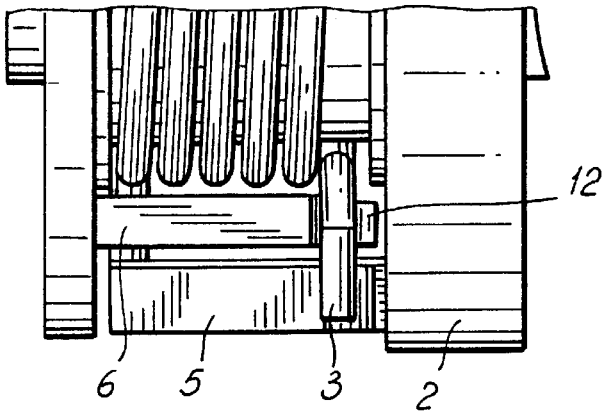
FIG. 4 is a top plan view of a portion of the embodiment in FIG. 1.

From FIGS. 1–3, it can be seen how the leg 3 is held by the limiting oblique surfaces 8 and 9 while the opposite leg 4 of the spring is engaged on the surfaces at the back side of the parts 5 and 6. Due to the oblique limiting surfaces 8 and 9, the leg 3 of spring 1 bears equally against the oblique surfaces so that rotation of the lever part in either direction will result in displacement of leg 3 from the oblique surfaces onto the respective parallel surface 11 or 12 while the leg 4 will engage the back side of the other part.

Thus, a construction is provided for the spring assembly in which there is no play between the rotor and the housing and in which a defined rest or neutral position is provided between the housing and lever parts 5 and 6 in which relative movement is resisted.

When the throttle valve 7 is driven by the electric motor in either direction, the lever part 5 is rotated accordingly to cause the leg 3 of the spring to slide off one of the oblique limiting surfaces 8 or 9 depending on the direction of rotation such that the leg 3 of the spring will now ride on one of the parallel limiting surfaces 11 or 12, enabling the rotor to reset the throttle valve to the selected position. In order to reset the assembly to the rest or neutral position, the oblique limiting surface 8 or 9 presses the leg 3 back into the rest position.

Figure 5:
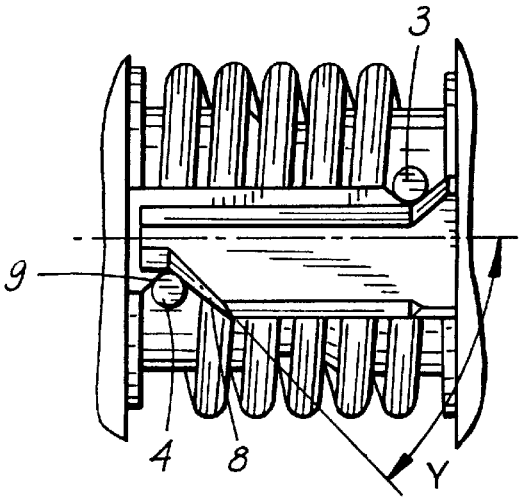
FIG. 5 is similar to FIG. 3 and shows a second embodiment of the invention.

FIG. 5 shows an arrangement in which the leg 4 of the spring is also received in oblique limiting surfaces at the back side of the housing and lever parts 5 and 6 as explained above for leg 3. This construction permits larger tolerances in the construction of the spring arrangement.

Advantageously, the limiting surfaces 8 and 9 are inclined in opposite directions at an angle Y of 45° with respect to the limiting surfaces 11 and 12 extending parallel to the rotational axis 10.

Figure 6:
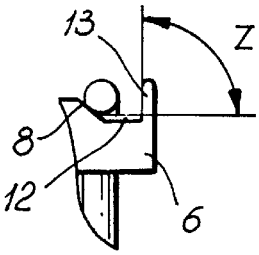
FIG. 6 is a detail of part of the spring assembly showing a modification thereof.

As illustrated in FIG. 6, lever part 6 is provided with a projection 13 at the end of the limiting surface 12 to serve as a stop for the leg 3 of the spring. The projection 13 extends at an angle Z with respect to the limiting surface 12 of 90°.

With the construction in accordance with the invention, a larger production and component tolerance can be obtained which provides an advantage in the production of the parts. The provision of the elimination of the rotational play in the neutral position substantially improves the operation of the throttle valve connection.

Although the invention has been described in relation to specific embodiments thereof, it will become apparent to those skilled in the art that numerous modifications and variations can be made within the scope and spirit of the invention as defined in the attached claims.

What is claimed is:

1. A spring assembly in a throttle valve connection for control of combustion air to an internal combustion engine, said throttle valve connection having a housing and a rotor, said rotor being movable in opposite directions to control flow of combustion air, said spring assembly comprising:

a housing part secured to said housing, a lever part secured to said rotor, a spring having first and second legs at respective opposite ends of the spring, said first and second legs of said spring engaging said housing part and said lever part, said rotor having a neutral position in which said spring is free of stress, said housing part and said lever part having respective oblique surfaces engaging one of said legs of the spring in said rest position to resist relative rotation of said parts and of said rotor relative to said housing.

2. A spring assembly as claimed in claim 1, wherein said housing part and said lever part have respective surfaces extending parallel to an axis of rotation of said rotor, said one leg of said spring being displaceable from said oblique surfaces and engaged on said parallel surfaces when the rotor is rotated from said neutral position.

3. A spring assembly as claimed in claim 2, wherein said oblique surfaces of said parts face in opposite directions and extend at an angle of 45° relative to said parallel surfaces of said parts.

4. A spring assembly as claimed in claim 2, wherein said housing part and said lever part have respective further parallel surfaces opposite the first said parallel surfaces, said other leg of the spring engaging said further parallel surfaces of said housing part and said rotor part.

5. A spring assembly as claimed in claim 1, wherein said oblique surfaces of the housing part and of the lever part are inclined in opposite directions.

6. A spring assembly as claimed in claim 1, wherein said housing part and said lever part have further respective oblique surfaces which the other of said legs of the spring engage in said rest position.

7. A spring assembly as claimed in claim 1, wherein one of said housing and lever parts has an end adjoining said oblique surface thereon, said one of said parts including a projection at said end to serve as a stop for said one leg of said spring.

8. A spring assembly as claimed in claim 7, wherein said projection extends at an angle of 90° relative to the parallel surface of said one of said parts.

* * * * *